United States Patent [19]

Johnson et al.

[11] 4,275,829

[45] Jun. 30, 1981

[54] MAILBOX AND METHOD OF MAKING SAME

[75] Inventors: Joseph S. Johnson; Carl A. Stiles, both of Springfield, Mo.

[73] Assignee: Dayco Corporation, Dayton, Ohio

[21] Appl. No.: 94,420

[22] Filed: Nov. 15, 1979

[51] Int. Cl.[3] ..... A47G 29/12

[52] U.S. Cl. ..... 232/17; 220/4 F; 232/45

[58] Field of Search ..... 232/17, 35, 38, 45; 85/80, 5 R; 220/4 R, 4 F

[56] References Cited

U.S. PATENT DOCUMENTS

| | | | |
|---|---|---|---|
| 1,130,288 | 3/1915 | Hubbard | 232/45 |
| 1,209,550 | 12/1916 | Buckwalter | 232/17 |
| 2,730,298 | 1/1956 | Haseroot | 232/35 |
| 3,177,540 | 4/1965 | Hall et al. | 85/80 |
| 3,233,502 | 2/1966 | Fernberg | 85/80 |
| 3,405,835 | 10/1968 | Eby | 220/4 F |
| 3,756,115 | 9/1973 | Schuplin | 85/5 R |
| 4,160,520 | 7/1979 | Cluthe | 232/17 |

*Primary Examiner*—Roy D. Frazier
*Assistant Examiner*—Peter A. Aschenbrenner
*Attorney, Agent, or Firm*—Charles E. Bricker

[57] ABSTRACT

A mailbox and method of making same are provided wherein such mailbox comprises a plurality of enclosing walls, shear pins fastening the enclosing walls together, and a readily opened and closed access door with each of the shear pins having a strength which is substantially less than the strength of the enclosing walls and door so that upon subjecting the mailbox to high impact loads the shear pins shear resulting in disassembly of the mailbox while keeping the enclosing walls and door substantially intact.

9 Claims, 9 Drawing Figures

MAILBOX AND METHOD OF MAKING SAME

BACKGROUND OF THE INVENTION

1. Field of the Invention

This invention relates to mailboxes and to a method of making such mailboxes.

2. Prior Art Statement

Many mailboxes have been proposed for both rural and door-to-door delivery, and such mailboxes may be made of various materials, designs, and constructions. However, particularly in rural areas, the mailboxes are usually supported on an associated supporting structure or post adjacent a road for easy access by a mail carrier. The close proximity of such mailboxes to a road often results in the mailboxes being accidentally struck by vehicles. In addition, rural mailboxes are often the target of vandals. However, the mailboxes proposed heretofore are so constructed that once they are subjected to high impact loads, either by accident or intentional striking thereof, they are permanently damaged and require either costly repair or complete replacement.

SUMMARY

It is a feature of this invention to provide a mailbox of simple and economical construction which basically disassembles upon being subjected to ordinarily damaging loads thereby keeping the main component portions of the mailbox substantially intact.

Another feature of this invention is to provide a mailbox of the character mentioned comprising a plurality of enclosing walls, means fastening the enclosing walls together, and a readily opened and closed access door for the mailbox wherein the fastening means comprises a plurality of shear pins each having a strength which is substantially less than the strength of the enclosing walls and door so that upon subjecting the mailbox to high impact loads the shear pins shear resulting in disassembly of the mailbox while keeping the enclosing walls and door substantially intact.

Another feature of this invention is to provide a mailbox of the character mentioned which also has a shear pin hingedly fastening the access door to at least one of the enclosing walls of such mailbox so that upon subjecting the access door to high loads its shear pin also shears resulting in the door falling away from the one wall yet without substantial damage thereto.

Another feature of this invention is to provide a mailbox of the character mentioned made entirely of polymeric material.

Another feature of this invention is to provide a mailbox of the character mentioned which may be sold in disassembled kit form for optimum economy.

Another feature of this invention is to provide a mailbox of the character mentioned made of polymeric material in the form of synthetic plastic material.

Another feature of this invention is to provide a mailbox of the character mentioned which is basically maintenance free and which is permanently decoratively colored.

Another feature of this invention is to provide a mailbox of the character mentioned consisting of four parts which define the entire enclosing structure thereof and wherein two of such parts may be substantially identical.

Another feature of this invention is to provide a mailbox of the character mentioned having an improved rear wall disposed opposite the access door wherein such rear wall provides improved strength for the mailbox as well as improved weatherproofing therefor.

Another feature of this invention is to provide a method of making a mailbox of the character mentioned.

Therefore, it is an object of this invention to provide a mailbox and method of making same having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
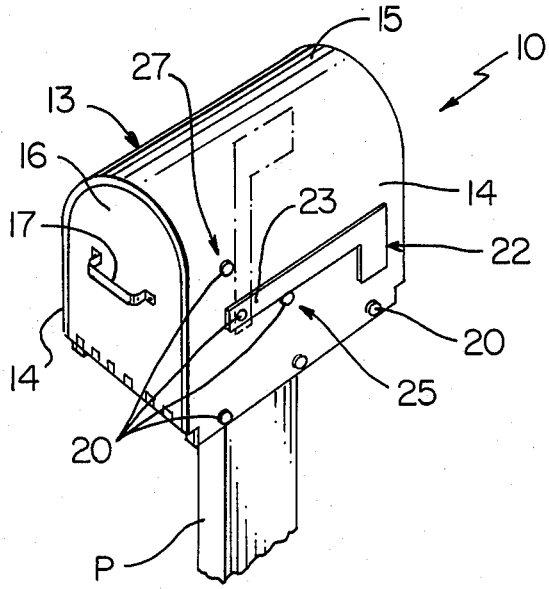
FIG. 1 is a perspective view of one exemplary embodiment of the mailbox of this invention fastened on a supporting post and wherein the lower portion of such post is broken away.

Reference is now made to FIG. 1 of the drawings which illustrates one exemplary embodiment of the mailbox of this invention and such mailbox is designated generally by the reference numeral 10. The mailbox 10 is of simple and economical construction and comprising a minimum of component parts and the simplicity of construction and minimum parts enable such mailbox to be sold competitively in a disassembled condition in a flat rectangular carton enabling shipping, storage, and stocking of such mailbox in a minimum amount of space.

Figure 2:
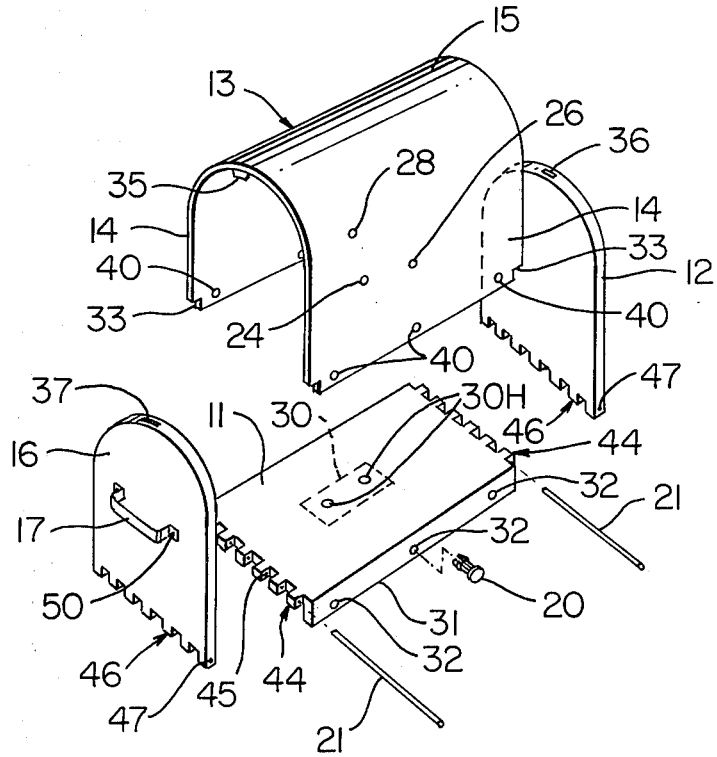
FIG. 2 is an exploded perspective view of the mailbox of FIG. 1 showing the main component parts thereof minus the flag and illustrating a single-piece structure which defines the top wall and side walls of such mailbox arranged in U-shaped form.
Figure 3:
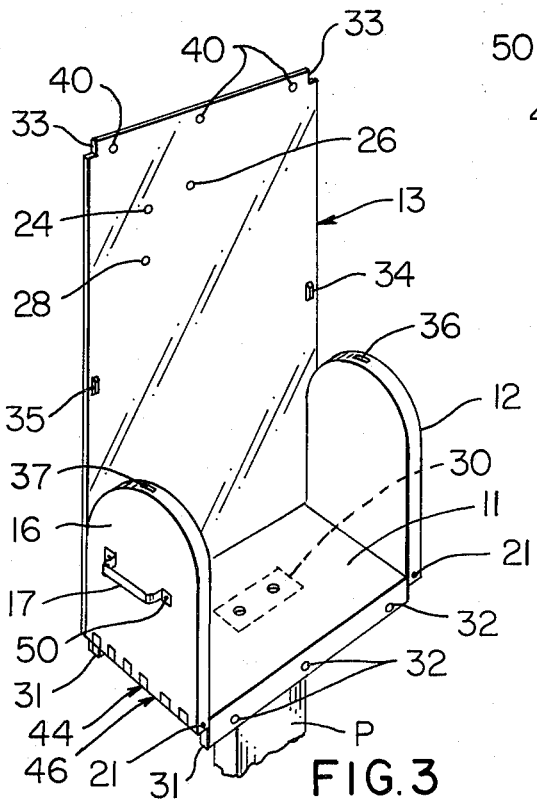
FIG. 3 is a perspective view illustrating the components of FIG. 2 partially assembled to highlight the method of making the mailbox of this invention.

As seen in FIGS. 1–3, the mailbox 10 is comprised of a plurality of enclosing walls comprising a bottom wall 11, a rear wall 12, and a roughly U-shaped wall, indicated generally by the reference numeral 13 and defines what may be considered a pair of side walls 14 and a domed or outwardly convex top wall 15 for the mailbox 10. The mailbox 10 also has a readily opened and closed access door 16 which is provided with a handle 17.

Figure 4:
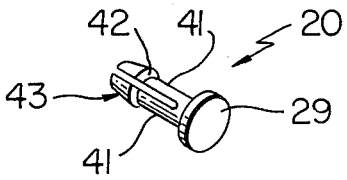
FIG. 4 is an enlarged view of the most used type of shear pin comprising the mailbox of this invention.

In accordance with the teachings of this invention the ıailbox 10 comprises a plurality of shear pins; and, the hear pins are of two types with one type being best lustrated in FIG. 4 and designated by the reference umeral 20 and the other type being in the form of an longate rod-like shear pin 21 and shown in FIG. 2. Dnly two shear pins 21 are required with one of such hear pins 21 holding the bottom portion of the rear vall 12 in position against the bottom wall 11 and the ther shear pin 21 serving the dual purpose of fastening he door 16 to the bottom wall 11 while serving as a inge pin for such door enabling easy opening and closıg movements thereof.

Each shear pin 20 and 21 has a strength which is ubstantially less than the strength of the enclosing valls 11–13 and door 16 so that upon subjecting the ıailbox to high impact loads, such as high impact loads aused by striking either accidentally or intentionally, he shear pins 20–21 shear resulting in disassembly of he mailbox yet keeping the enclosing walls and door ubstantially intact. Once the access door 16 or the rear vall 12 is subjected to a high impact load the shear pin 1 associated with each merely shears or breaks apart; nd, in the case of the door 16 such door merely falls way from the bottom wall 11 without substantial damge thereto.

The mailbox 10 and in particular the walls 11, 12, and 3 together with the door 16 are preferably made of olymeric material and such polymeric material is prefrably synthetic plastic material having high strength nd in particular high strength to impact loads of the ype produced by an object striking thereagainst. Once he polymeric material is subjected to such high impact oads the construction thereof is such that it resists reaking, cracking, or other permanent deformation.

The shear pins 20 and 21 are also preferably made of olymeric material in the form of synthetic plastic mateial; however, such shear pins have a strength which is ubstantially less than the strength of the walls and door f the mailbox to thereby assure that pins 20 and 21 hear upon being subjected to high impact loads and as reviously set forth.

The mailbox 10 also has a suitable flag 22 which is dapted to be raised and lowered and for the purpose vell known in the art. The flag 22 has a lower end ortion 23 thereof pivotally supported by a pin 20 on ıe enclosing wall 13 and the flag support pin 20 extends ırough an opening in its lower portion and through a ooperating opening 24 in the enclosing wall 13.

Referring to FIGS. 1 and 2 it is seen that the flag 22 as another pin 20, shown at 25, associated therewith or the purpose of supporting the flag in its lowered osition, illustrated by a solid line showing of the flag, nd such pin 20 extends through an opening 26 in the nclosing wall 13. The flag 22 also has another pin 20, hown at 27, associated therewith for the purpose of ıpporting the flag in its raised position, illustrated by otted line showing of the flag, and such pin 20 extends ırough an opening 28 in the enclosing wall.

The pin 20 at 27 supporting flag 22 in its raised posion is disposed to the forward side of a vertical line ırough the pin which pivotally supports the flag 22 hereby the raised flag is disposed slightly off center om such vertical line, once raised, and thereby reıains raised until manually lowered. The pins 20 have eads 29 (FIG. 4) of sufficient thickness that the lower aff-like portion of the flag is easily supported therеagainst to assure adequate support of the flag 22 in both its lowered or raised position.

The flag 22 may be made of any suitable material and preferably the entire flag is made of a substantially rigid polymeric material such as a synthetic plastic material. The flag material is preferably an antifriction material so that as the flag staff slideably engages the sidewall portion 14 of the enclosing wall 13 during lowering or raising of the flag there is a minimum resistance to movement.

The bottom wall 11 of the mailbox 10 has reinforcing means 30 provided in the central portion thereof and such reinforcing means may be an increased thickness portion 30 extending beneath the lower surface of the bottom wall 11 or such reinforcing means may be in the form of a high strength plate (such as a metal plate) embedded in the polymeric material defining the bottom wall 11. The bottom wall 11 with its reinforcing means 30 has a pair of holes each designated by the same reference numeral 30H provided therethrough and the holes or openings are particularly adapted to receive fasteners therethrough. In those applications where the mailbox support is a wooden post P, the fasteners may be wood screws, or the like, which are extended through the openings 30H and threaded into the top portion of the post P.

The bottom wall 11 has a pair of depending integral flanges each designated by the same reference numeral 31 extending from opposite side edges thereof and the flanges have spaced openings 32 therein that are particularly adapted to receive associated shear pins 20 therethrough. The flanges 31 extend beneath the bottom surface of the bottom wall 11 and the openings 32 are provided therein so that the shear pins 20 are readily visible and accessible so that in the event such shear pins are sheared, any parts thereof remaining therein may be easily removed by pushing same out of their associated openings.

The enclosing wall 13 is basically of rectangular outline as shown in FIG. 3 and such wall is comparatively easily formed and installed in position. The wall 13 is defined from a single basically flat sheet and such sheet is also designated by the reference numeral 13. The wall defining sheet 13 has rectangular cutouts 33 at its corners and each cutout at the rear end of the sheet defines a pair of surfaces one of which coincides with the bottom surface of the rear wall 12 and the other surface coincides with the vertical edge of an associated flange 31. Each cutout at the forward end of the sheet, defines a pair of surfaces one of which coincides with the bottom surface of the closed door 16 and the other surface coincides with the vertical edge of an associated flange 31.

The wall or sheet 13 also has a pair of projections shown as projections 34 and 35 which are disposed centrally at opposite ends on a center line through the sheet. The projection 34 is particularly adapted to mesh with a corresponding recess 36 in the rear wall 12 while the projection 35 is particularly adapted to mesh with a recess 37 in the door 16. The projection 35 is of comparatively smaller extension from the inside surface of the wall 13 and serves as a detenttype latch for holding the door 16 in its closed position. On the other hand, projection 34 is of comparatively larger extension and when received within the recess 36, it locks the rear wall 20 so as to prevent movement thereof from its vertical position.

The sheet 13 has a plurality of aligned openings 40 adjacent each of its opposite side edges. The openings 40 along one side edge are particularly adapted to be disposed in aligned relation within openings 32 of an associated flange 31 and associated shear pins 20 pushed in position whereupon the sheet 13 is bent or bowed in position to define the U-shaped therein and the wall 13 and the openings 40 at the opposite side of the sheet are aligned with associated openings 32 and once again associated shear pins 20 are pushed in position.

Each shear pin 20 is made of a polymeric material in the form of a synthetic plastic material and each shear pin is of the expandible type. Each shear pin 20 has a head portion 29 of substantial thickness, as previously mentioned, and a plurality of expandible and contractible tang-like members 41 extending from the head with the tang-like members having a radially outwardly extending shoulder 42 of a slightly larger diameter. The tang-like members 41 have inwardly tapered portions extending from their shoulders which cooperate to define a bullet-nosed configuration 43 in the inner end of each pin 20. The bullet-nosed end 43 of each shear pin 20 enables easy insertion thereof through a pair of aligned openings 40 and 32; and, once the head 29 of the shear pin 20 engages the outside surface of the sheet 13 the dimensions of the cooperating components are such that the shoulders 42 clear the inside surface of the flange 31 and, in essence, snap lock the shear pin in position.

The bottom wall 11 also has hinge means comprised of a plurality of identical projections and recesses comprising a hinge structure 44 at each end thereof with each hinge structure 44 having projections and recesses and being provided with aligned openings 45 in the projections 44. The rear wall 12 and the door 16 each has a cooperating hinge structure at the lower edge thereof with the cooperating hinge structure being designated by the reference numeral 46 and comprising projections and recesses which are adapted to nest within the recesses and projections respectively of the hinge structure 44. Each hinge structure 46 has aligned openings 47 in its projections in a similar manner as the openings 45 of the projections of hinge structure 44.

To assemble lower part of the rear wall 12 and the hinged part of the door 16 in position, the cooperating hinge structure 44 and 46 are disposed in intermeshed relation as known in the art and an associated shear pin 21 is extended through aligned openings 45 and 47 at each end of the mailbox. It will be appreciated that the clearance provided between the associated intermeshed components of the hinge structures are such that the door 16 may be fully opened for access into the interior of the mailbox 10. The rear wall 12 is prevented from movement by projection 35 once the wall 13 is installed in position.

The door 16 has a handle 17 suitably provided thereon, as previously mentioned. The handle may also be installed in position utilizing a pair of shear pins 50. Each shear pin 50 is similar to the shear pin 20, though smaller in size and each shear pin 50 extends through associated aligned openings in an associated end portion of the handle 17 and in the door 16.

Each hinge structure 44 at each end of the bottom wall 11, including the openings 45 therein, may be provided employing any suitable manufacturing technique known in the art. For example, the entire bottom wall 11 with its hinge structures 44 may be defined by molding in a suitable mold device and utilizing extractible rod-like members to define the aligned openings 45. Likewise, the rear wall 12 and door 16 may be similarly molded in an associated mold device with hinge structure 46 and openings 47 similarly defined.

The sheet 13 may also be made by molding in the flat condition with the projections 34 and 35 defined integrally during the molding action and with the cutouts 33 and holes 40 in such sheet also being defined during the molding action. However, it will be appreciated that the sheet 13 may be cut from a sheet of flat stock of substantial size and the various holes 40 defined therein by drilling or similar action and with notches 33 suitably cut therein. The projections 34 and 35 in a sheet 13 cut from a larger sheet of flat stock may be fixed in position utilizing any suitable technique known in the art.

The rear wall 12 and door 16 are substantially identical with the exception of the handle 17 being provided on the door 16. Thus, prior to providing holes in the door 16 for receiving the pins 50 these two components may be interchanged resulting in lower costs of production and stocking of components.

The assembly of the mailbox 10 is achieved with optimum simplicity. In particular, the bottom wall 11 is suitably fastened on an associated support such as post P (FIG. 3) utilizing suitable fasteners extending through the openings 30H. The rear wall 12 and door 16 are then suitably installed merely by placing the hinge means 46 of each in aligned relation with associated hinge means 44 in the bottom wall 11 whereupon an associated shear pin 21 is installed in position in each set 45 and 47 of aligned openings. One side edge of the sheet 13 is then installed in position simply by inserting each of the three shear pins 20 through an associated set of aligned openings 32 and 40. At this stage of the assembly the mailbox construction has the appearance shown in FIG. 3.

The top unfastened portion of the sheet 13 may then be pulled and bowed around the wall 12 and door 16 causing the projections 34 and 35 to be received within recesses 36 and 37 respectively and thereby define the U-shaped wall 13 shown in exploded view in FIG. 2. The openings 40 at the opposite unfastened side edge of the sheet 13 are then disposed in aligned relation with the openings 32 whereupon it is a simple matter to simply push the three shear pins 20 therethrough and the assembly of the basic mailbox is complete. It is then a simple matter to install the flag in position merely by pushing a shear pin 20 through an opening in the staff of flag 22 and through the cooperating opening 24. The flag stops, defined by two shear pins 20, are then pushed through openings 26 and 28.

In this disclosure of the invention, the shear pins 20 and 21 have been described as being of a particular type. Similarly, the hinge means 44 and 46 have also been described as being a particular type together with their associated pins 21. However, it will be appreciated that the shear pins 20 and 21 and hinge means 44 and 46 may be of any suitable type known in the art.

The mailbox 10 is of optimum simplicity and basically comprises four substantially flat parts, the flag, handle, and various shear pins. All of these components may be assembled and packaged in a rectangular carton for shipment, storage, and stocking on a store shelf.

Another exemplary embodiment of the mailbox of this invention is illustrated in FIGS. 5–9 of the drawings. The mailbox of FIGS. 5–9 is very similar to the mailbox 10; therefore, such mailbox will be designated by the reference numeral 10A and representative parts of the mailbox 10A which are similar to corresponding parts of the mailbox 10 will be designated in the drawings by the same reference numerals as in the mailbox 10 and each followed by the letter designation A and not described again in detail. Only those parts or components of the mailbox 10A which are substantially different from similar parts or components of the mailbox 10 will be designated by a new reference numeral, also followed by the letter designation A, and described in detail.

Figure 5:
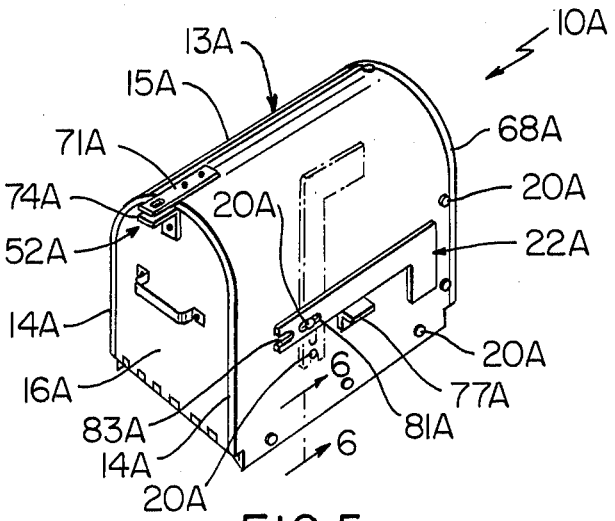
FIG. 5 is a perspective view similar to FIG. 1 and illustrating another exemplary embodiment of the mailbox of FIG. 1.
Figure 6:
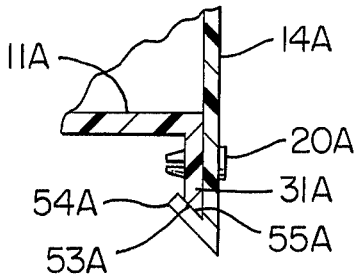
FIG. 6 is an enlarged fragmentary cross-sectional view taken essentially on the line 6—6 of FIG. 5.
Figure 7:
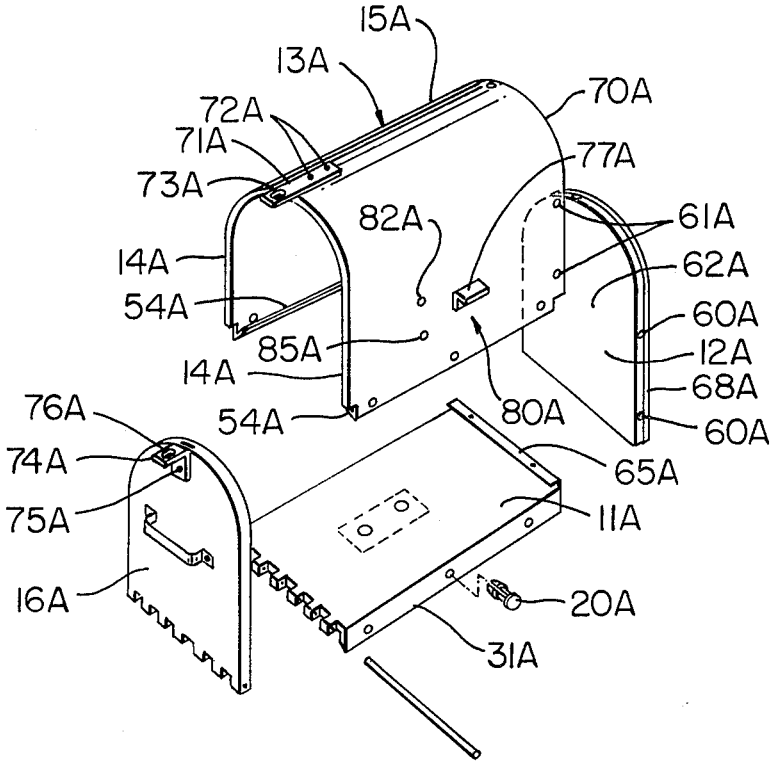
FIG. 7 is a view similar to FIG. 2 illustrating the mailbox of FIG. 5.

As illustrated in FIGS. 5 and 7, the mailbox 10A is comprised of a plurality of enclosing walls comprising a bottom wall 11A, a rear wall 12A, and a roughly U-shaped wall which is designated generally by the reference numeral 13A and defines a pair of side walls 14A and a top wall 15A. The mailbox 10A also has a readily opened and closed access door 16A which is provided with a handle and the mailbox also has a flag 22A.

The main differences between the mailbox 10A and the mailbox 10 are in the provision of certain additional features in the mailbox 10A which are not present in the mailbox 10. In particular, the mailbox 10A has improved weatherproofing between its bottom wall 11A and U-shaped wall 13A, improved weatherproofing between its rear wall 12A and the adjoining structure together with a rear wall design which increases the structural strength of the overall mailbox, locking means 52A, and a modified flag.

Each of the downwardly depending flanges 31A (FIG. 6) of the bottom wall 11A has an inclined surface 53A defining its bottom edge. Each inclined surface edge 53A is inclined such that a plane disposed thereagainst would pass through the central part of the bottom wall 11A. The U-shaped enclosing wall 13A is provided with an integral angled flange 54A at each of its lower edges; and, with the wall 13A in position each flange 54A is disposed at an acute angle with its adjoining side wall 14A. Each flange 54A has an inside surface 55A which is particularly adapted to engage an associated inclined surface 53A on a planar interface. Once the U-shaped wall 13A is installed in position the adjoining inclined surfaces 53A and 55A at each side define an associated weatherproof seal for the mailbox 10A.

The rear wall 12A provides improved strength for the overall mailbox as well as providing improved weather-proofing. The rear panel 12A has a roughly U-shaped flange 57A extending therearound (FIG. 8) and such flange has openings 60A extending through its parallel leg portions. The U-shaped enclosing wall 13A also has openings 61A extending through its side wall portions 14A which are adapted to be aligned with the openings 60A. Once the rear wall 12A is disposed in position for fastening each shear pin 20A is extended through an associated pair of aligned openings 60A and 61A.

Figure 8:
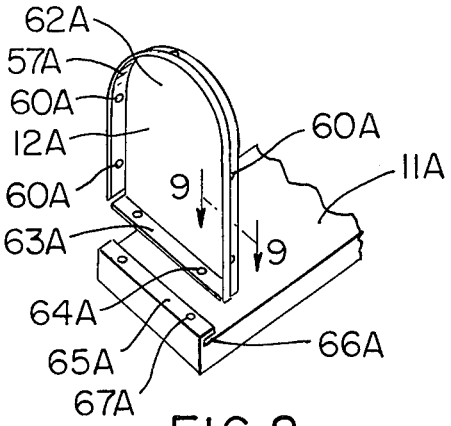
FIG. 8 is a fragmentary perspective view showing details of the construction of the rear wall of the mailbox of FIG. 5 together with a rear portion of the bottom wall.
Figure 9:
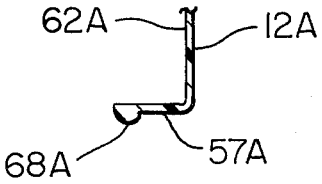
FIG. 9 is an enlarged fragmentary cross-sectional view taken essentially on the line 7—7 of FIG. 1.

As seen in FIGS. 8 and 9, the rear wall 12A has a central part 62A provided with a bottom outwardly extending flange 63A, and the flange 63A has a plurality of openings 64A extending therethrough. The bottom wall 11A of this example is provided with an integral substantially L-shaped flange 65A having a vertical leg and a horizontal leg defining a gap 66A between the horizontal leg and the top surface of the bottom wall 11A. The horizontal leg of the flange 65A has vertical openings 67A extending therethrough. Accordingly, to assemble the rear wall 12A of the mailbox 10A in position, the flange 63A is disposed or slid beneath the horizontal portion of the L-shaped flange 65A into the gap 66A and suitable fasteners similar to shear pins 20A may be installed through each set of aligned openings 64A and 67A.

As seen in FIG. 9, the flange 57A of the rear wall may be provided with a beak-like projection 68A which is particularly adapted to receive the rear edge 70A (FIG. 7) of the U-shaped wall 13A thereagainst for the purpose of providing improved weather-proofing between the rear wall 12A and the rear portion of the U-shaped wall 13A.

As indicated earlier, the mailbox 10A may be provided with locking means 52A. The locking means 52A comprises a flat rectangular strip 71A which is suitably fastened to the top portion of the U-shaped wall 13A by fasteners 72A and the flat strip 71A has an opening 73A in its terminal outer end portion. The locking means 52A also comprises an L-shaped member 74A which is suitably fastened with a fastener 75A to the top portion of the door 16A and the L-shaped member 74A also has an opening 76A provided in its terminal outer end portion. The openings 73A and 76A are disposed in aligned relation once the door 16A is closed, and are adapted to receive a locking device such as a lock therethrough, as is known in the art.

As indicated earlier, the mailbox 10A has a modified flag 22A. The flag 22A is particularly adapted to be supported on an L-shaped support bracket 77A which is suitably fastened to the U-shaped wall 13A as shown at 80A. The flag 22A has an elongate slot 81A in its staff portion which is particularly adapted to receive a shear pin 20A therethrough and through an opening 82A in the wall 13A so that the inside surface of the head portion of such shear pin engages the outside surface of flag staff thereby holding the flag against the side wall portion 14A of the U-shaped wall 13A while allowing movements of the flag relative to its fastening pin 20A. The flag 22A also has a cut-out 83A in its lower edge which is particularly adapted to be supported on another pin 20A which extends through an opening 85A in side wall portion 14A. Thus, it is a simple matter to move the flag 22A from its lowered solid line position of FIG. 5 to its raised dotted line position by simply pivoting the flag counterclockwise as viewed in FIG. 5 about its fastening shear pin 20A and manually lifting the flag vertically so that the bottom lowermost portion of the elongate slot 81A is disposed against the flag fastening pin 20A. The flag is then simply lowered so that the slot 83A is received around the outer part of the lower pin 20A whereby the flag is disposed and held by the lower pin 20A in the vertical position shown by dotted lines in FIG. 5.

The bottom wall 11A, U-shaped wall 13A, and rear wall 12A, of the mailbox 10A may be made using any suitable technique or manufacturing process known in the art. Preferably these components are made by molding or similar process.

Each mailbox 10 and 10A is preferably provided with a plurality of sets of shear pins such that once the mailbox is broken apart by severing its shear pins, it is a simple matter to substitute the new shear pins and reassemble the mailbox without a need to replace the entire mailbox. Further, the construction and arrangement of the various components of each mailbox 10 and 10A are such that each mailbox may be readily reassembled without requiring special skill and by anyone capable of reading simple instructions, which may be included with each disassembled mailbox. Obviously, each mailbox 10 and 10A may be sold fully assembled and with an extra set of shear pins.

Each mailbox 10 and 10A may be constructed of synthetic plastic material, as mentioned earlier, which lends itself to making the mailbox of plastic materials having inherent colors therein whereby not only is a product provided which is basically maintenance free and will not corrode but the mailbox has high aesthetic appeal. Each mailbox may be provided in a plurality of colors, for example, the flag 22 may be one color, the U-shaped wall 13 of another color, the rear wall 12 and door 16 another color, and the shear pins still another color. Obviously, any desired combination and number of colors may be used including the usual red, white, and blue.

Each exemplary embodiment of the mailbox disclosed herein is shown in a preferred form having a particular style and having certain walls of specific shapes. However, it is to be understood that the mailbox of this invention may be of any desired configuration.

While present exemplary embodiments of this invention, and methods of practicing the same, have been illustrated and described, it will be recognized that this invention may be otherwise variously embodied and practiced within the scope of the following claims.

What is claimed is:

1. In a mailbox comprising a plurality of enclosing walls, means fastening said enclosing walls together, and a readily opened and closed access door for said mailbox; the improvement wherein said fastening means comprises a plurality of shear pins each having a strength which is substantially less than the strength of said enclosing walls and door so that upon subjecting said mailbox to high impact loads said shear pins shear resulting in disassembly of said mailbox while keeping said enclosing walls and door substantially intact; an additional shear pin hingedly fastening said access door to at least one of said enclosing walls so that upon subjecting said access door to high impact loads the shear pin hingedly fastening same also shears, resulting in the door falling away from said one wall while remaining substantially intact; said enclosing walls, door, and shear pins being made of a synthetic plastic polymeric material; said enclosing walls comprising a bottom wall, a rear wall, and a U-shaped wall fastened over said bottom wall and around said rear wall and door; said bottom wall having a pair of downwardly depending flanges extending from its opposite said edges, each of said flanges having an inclined surface which is inclined upwardly toward the center of said bottom wall, said U-shaped wall being provided with an integral flange at each of its lower edges, each of said flanges having an inside surface which engages said upwardly inclined surface to provide improved weatherproofing for the mailbox.

2. A mailbox as set forth in claim 1 and further comprising locking means for said door.

3. A mailbox as set forth in claim 2 in which said locking means comprises a flat strip fixed to said U-shaped wall and having an opening therein and a L-shaped strip fixed to said door and having a cooperating opening therein, said openings being adapted to be disposed in aligned relation with said door closed for receiving a lock therethrough.

4. A mailbox as set forth in claim 1 and further comprising an annular bead in said rear wall which is particularly adapted to receive a rear edge of said U-shaped wall thereagainst to provide improved weatherproofing between said rear wall and said U-shaped wall.

5. A mailbox as set forth in claim 4 in which, said rear wall has a central part provided with a bottom outwardly extending flange, said bottom wall has an integral substantially L-shaped flange which has a vertical leg and a horizontal leg defining a gap between the horizontal leg and a top surface of the bottom wall, and said bottom flange of the rear wall is disposed beneath the horizontal portion of the L-shaped flange in said gap and fastened in position by fasteners extending between said horizontal leg and bottom flange.

6. A mailbox as set forth in claim 1 and further comprising a flag pivotally fastened to said U-shaped wall and means for supporting said flag in a raised position and in a lowered position.

7. A mailbox as set forth in claim 1 and further comprising, a hinge structure at each end of said bottom wall, a cooperating hinge structure comprising the bottom portion of each of said door and rear wall, and wherein said shear pins comprise a pair of elongate shear pins, one of said elongate shear pins fastening said hinge structure of said rear wall and an associated hinge structure of said bottom wall and the other of said elongate shear pins fastening said hinge structure of said door and an associated hinge structure of said bottom wall, said elongate shear pin fastening said door also serving as a hinge pin for said door.

8. A mailbox as set forth in claim 7 in which each of said hinge structures comprises alternating projections and recesses, said projections having aligned openings therein for receiving an associated elongate shear pin therethrough.

9. A mailbox as set forth in claim 1 in which said plurality of said shear pins comprises a plurality of locking shear pins each having, a head portion of substantial thickness, a plurality of expandible and contractible tang-like members extending from the head portion with the tang-like members having radially outwardly extending shoulders extending from their outer ends, and said tang-like members having inwardly tapered portions extending from their shoulders which cooperate to define a bullet-nosed configuration in the forward end of each locking shear pin, each bullet-nosed end of each shear pin enabling easy insertion thereof through associated opening means, said shoulders being adapted to provide a locking action.

* * * * *